US005720653A

United States Patent [19]

Miller et al.

[11] Patent Number: 5,720,653

[45] Date of Patent: Feb. 24, 1998

[54] UNIVERSAL POLISHING FIXTURE FOR POLISHING OPTICAL FIBER CONNECTORS

[75] Inventors: Nancy Lebeis Miller, Harrisburg; Randall B. Paul, Elizabethville, both of Pa.; Marinus Hendrikus Johannes Kreijveld, Sint-Oedenrode, Netherlands

[73] Assignee: The Whitaker, Wilmington, Del.

[21] Appl. No.: 705,931

[22] Filed: Aug. 30, 1996

Related U.S. Application Data

[60] Provisional application No. 60/003,094, Aug. 31, 1995.

Related U.S. Application Data

[63] Continuation-in-part of Ser. No. 337,585, Nov. 10, 1994, Pat. No. 5,674,114.

[51] Int. Cl.[6] ..... B24B 7/22

[52] U.S. Cl. ..... 451/278; 451/41; 451/365

[58] Field of Search ..... 451/41, 278, 259, 451/390, 365

[56] References Cited

U.S. PATENT DOCUMENTS

| | | | |
|---|---|---|---|
| 4,693,035 | 9/1987 | Doyle | 51/125 |
| 4,819,386 | 4/1989 | Struyf | 51/281 R |
| 4,831,784 | 5/1989 | Takahashi | 51/131.1 |
| 4,905,415 | 3/1990 | Moulin | 51/124 R |
| 5,109,460 | 4/1992 | Baek et al. | 385/115 |
| 5,140,779 | 8/1992 | Grois | 51/217 R |
| 5,216,846 | 6/1993 | Takahashi | 51/326 |
| 5,321,917 | 6/1994 | Franklin et al. | 51/217 R |
| 5,351,445 | 10/1994 | Takahashi | 451/271 |

FOREIGN PATENT DOCUMENTS

| | | |
|---|---|---|
| 0 579 056 A1 | 1/1994 | European Pat. Off. . |
| 0 621 107 A1 | 10/1994 | European Pat. Off. . |
| 0 657 247 A2 | 6/1995 | European Pat. Off. . |

OTHER PUBLICATIONS

Abstract and Drawings 15799.

JDS Fitel "SFP 550 PAC Polishing Machine" Operating Manual; Mar. 1993; 1 Page.

*Primary Examiner*—Eileen P. Morgan

[57] ABSTRACT

An optical fiber connector polishing fixture (20) for use with a polishing machine (22). The polishing machine polishes optical fiber connectors which are retained in such fixture by clamping a ferrule of the connector in a connector clamping assembly (32). The fixture (20) includes a plate portion (24) which has a perimeter edge. A plurality of arms (28) extend from the plate portion (24) for attachment to a polishing machine (22). A plurality of segments (30) of said plate portion are defined by areas between neighboring arms (28). A plurality of connector clamping assemblies (32) are positioned within each segment (30) of the plate portion (24). These connector clamping assemblies (32) are generally, radially oriented within the corresponding segment (30). Each clamping assembly (32) includes a nest (46) for retaining a connector, a primary slot (48) extending from the perimeter of the plate portion through the nest (46), and a secondary slot (50) spaced away from the primary slot (48) and extending from the perimeter of the plate portion to a position proximate to the nest (46). A moveable beam (52) is defined between the primary slot (48) and the secondary slot (50) and is displaceable relative to the plate portion by a clamping mechanism (44) attached thereto for clamping a connector within the nest.

13 Claims, 5 Drawing Sheets

UNIVERSAL POLISHING FIXTURE FOR POLISHING OPTICAL FIBER CONNECTORS

The present patent application is a Continuation-In-Part of patent application Ser. No. 08/337,585 Nov. 10, 1994 now U.S. Pat. No. 5,674,114.

This is a continuation of a provisional application 60/003,094 filed Aug. 31, 1995.

BACKGROUND

The present invention relates to tooling or fixtures for use with a polishing machine to secure a plurality of optical fiber connectors in the fixture to position such connectors for high precision polishing procedures.

Optical fiber connectors are a critical link in any fiber optic transmission system. Optical fiber connectors provide a mechanical link between two ends of optical fibers thereby permitting transmission through the connector. Due to the characteristics of optical fiber transmission systems, it is important that the connecting end of fiber connector satisfy high precision standards in order to prevent signal degradation.

With the increasing importance of optical fiber transmission systems comes the increasing importance of the connector assembly. Connector assemblies must be prepared more quickly and in larger quantities than ever before. Prior art polishing systems employed large, generally rectangular connector polishing fixtures which position the connectors over the polishing surface of the polishing machine. The fixtures typically accommodate multiple positions of a single connector style and require substantial setup time to position and secure the connectors to the fixture.

A single polishing operation is time consuming and the polishing machine may be expensive. It is important, therefore, to maximize the efficiency of each polishing operation. If a polishing operation is initiated with less than all of the positions on a fixture being filled, the empty connector positions effectively reduce the efficiency and increase the cost of the polishing operation.

In certain applications, optical fiber connectors are terminated and polished at a field location and out of a controlled manufacturing environment. Field termination may require polishing of a variety of connector styles in a single polishing operation. By using fixtures which are dedicated to a specific style of connector, a person operating in the field must carry multiple fixtures, a fixture for each type of connector they may encounter. The necessity to carry multiple fixtures lowers field termination efficiency and increases the cost of the field operations. Furthermore, multiple fixtures add to the weight and bulk of the equipment to be carried.

There is a need, therefore, for a fixture which accommodates a wide variety of connector styles. Furthermore, there is a need for a universal fixture which provides sufficient clamping force on a variety of connectors regardless of the style of connectors. Additionally, there is a need for a clamping fixture which is forgiving of variations in manufacturing tolerances which tend to increase the range of dimensions which must be accommodated by such a universal fixture.

OBJECTS AND SUMMARY

A general object satisfied by the claimed invention is to provide a clamping fixture which accommodates a variety of optical fiber connector geometries on a single fixture.

Another object satisfied by the claimed invention is to provide an optical fiber connector fixture which is capable of holding a variety of connector geometries and which securely position the clamped connectors on a polishing machine.

Yet a further object of the present invention is to provide an optical fiber connector polishing fixture which provides improved connector clamping action as a result of a moveable cantilevered beam used to clamp the connectors.

Briefly, and in accordance with the foregoing, the present invention envisions an optical fiber connector polishing fixture for use with a polishing machine. The polishing machine polishes optical fiber connectors which are retained in such fixture by clamping a ferrule of the connector in a connector clamping assembly. The fixture includes a plate portion which has a perimeter edge. A plurality of positioning structures extend from the plate portion for positioning the fixture relative to a polishing machine. A plurality of segments of said plate portion are defined by areas between neighboring positioning structures. A plurality of connector clamping assemblies are positioned within each segment of the plate portion. These connector clamping assemblies are generally, radially oriented within the corresponding segment. Each clamping assembly includes a nest for retaining a connector, a primary slot extending from the perimeter of the plate through the nest, and a secondary slot spaced away from the primary slot and extending from the perimeter of the plate to a position proximate to the nest. A moveable beam is defined between the primary slot and the secondary slot and is displaceable relative to the plate by a clamping mechanism attached thereto for clamping a connector within the nest.

BRIEF DESCRIPTION OF THE DRAWINGS

The organization and manner of the structure and function of the invention, together with further objects and advantages thereof, may be understood by reference to the following description taken in connection with the accompanying drawings, wherein like reference numerals identify like elements, and in which.

DESCRIPTION

Figure 1:
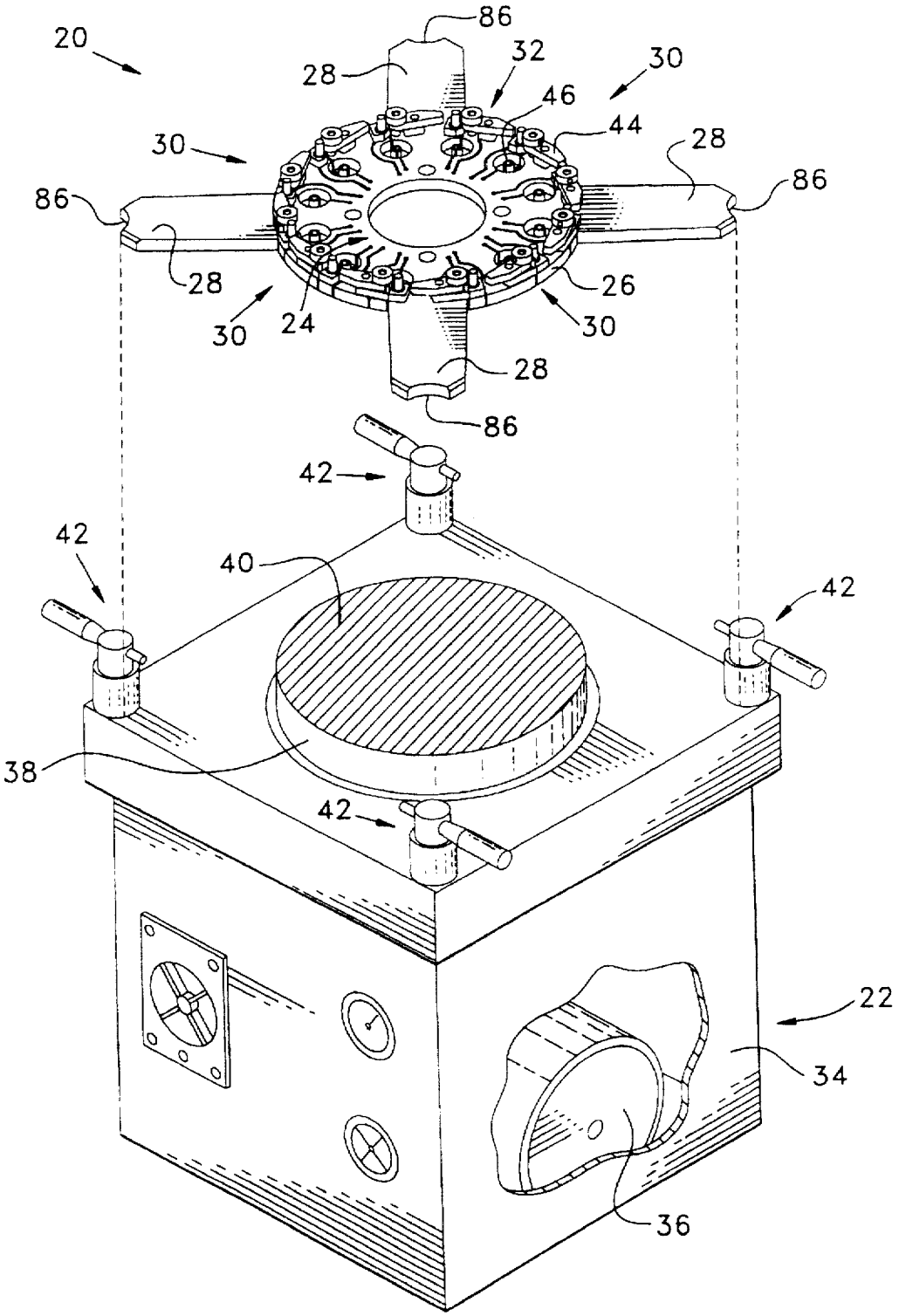
FIG. 1 is an exploded perspective view of a universal polishing fixture in accordance with the present invention positioned for engagement over a polishing machine with which the fixture is used.

While the present invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

With reference to FIG. 1, a fixture 20 of the claimed invention is shown displaced from a polishing machine 22 with which the fixture 20 is used. The fixture 20 includes a body portion or central plate portion 24 having perimeter portions 26. Positioning structures shown herein as a plurality of arms 28 extend from areas of the body portion between the perimeter portions 26. A plurality of segments 30 are defined between neighboring positioning structures 28, 28. Each segment includes at least one and generally a group of a plurality of clamping assemblies 32 which are positioned on the plate portion 24. The clamping assemblies 32 are configured to clamp a portion of an optical fiber connector on the plate portion 24 for polishing by the polishing machine 22.

The polishing machine 22 includes a housing or frame 34 to which a drive motor 36 is attached. The drive motor 36 operates a moveable table 38 which generally rotates in a circular or eccentric pattern to move an abrasive surface 40 positioned thereon relative to the fixture 20 when the fixture is positioned over the machine 22. Movement of the abrasive surface 40 relative to the fixture 20 provides a polishing action to polish the ends of the connectors retained in the clamping assemblies 32.

Attachment of the fixture 20 to the machine 22 is facilitated by fixture retaining clamps 42 positioned at outer edges of the machine 22 as shown in FIG. 1. Other configurations of the support structures or arms 28 and the fixture retaining clamps 42 may be provided. In the configuration of the machine 22 and fixture 20 as shown in FIG. 1, four arms 28 are provided on the fixture 20 which are oriented for being secured by a corresponding set of four fixture retaining clamps 42. Further description of the fixture retaining clamps 42 and the attachment of the fixture 20 thereto is provided hereinbelow.

Having briefly described the overall configuration of the fixture 20 and its relationship to a polishing machine 22, further reference is made to the specific structures and functions of the fixture 20. With reference to FIGS. 2–7, enlarged views of the fixture 20 (FIG. 2), the segments 30 and portions thereof (FIGS. 2–7) and the clamping assemblies 32 (FIGS. 1, 5–7) are provided. FIGS. 1 and 5 show clamping mechanisms 44 which are used to impose forces on the clamping assemblies 32. These clamping mechanisms 44 are omitted from FIGS. 2–4 in the interest of clarity. Reference to clamping mechanisms will be clarified by reference to FIGS. 1 and 5. Additional information regarding the structure and function of the clamping mechanisms 44 is incorporated herein by reference to U.S. Pat. No. 5,321,917 to Franklin et al., which is assigned to the assignee of the invention set forth in the present application. It should also be understood that other clamping mechanisms 44 may be used with the general structure of the clamping assembly 32 as set forth herein.

The articles to be retained in the clamping assemblies are described herein as optical fiber connectors. More specifically, ferrules of the connectors are clamped in the clamping assemblies to retain the connectors on the plate while an exposed end of the ferrule is polished. Other articles, having a generally axial orientation may be clamped in the clamping assemblies so that exposed ends thereof may be polished. Further, the connectors are shown herein to be oriented generally perpendicular to the polishing machine. However, the connectors, more specifically the ferrules may be oriented at an angle relative to the polishing machine to achieve an angle polish.

Figure 2:
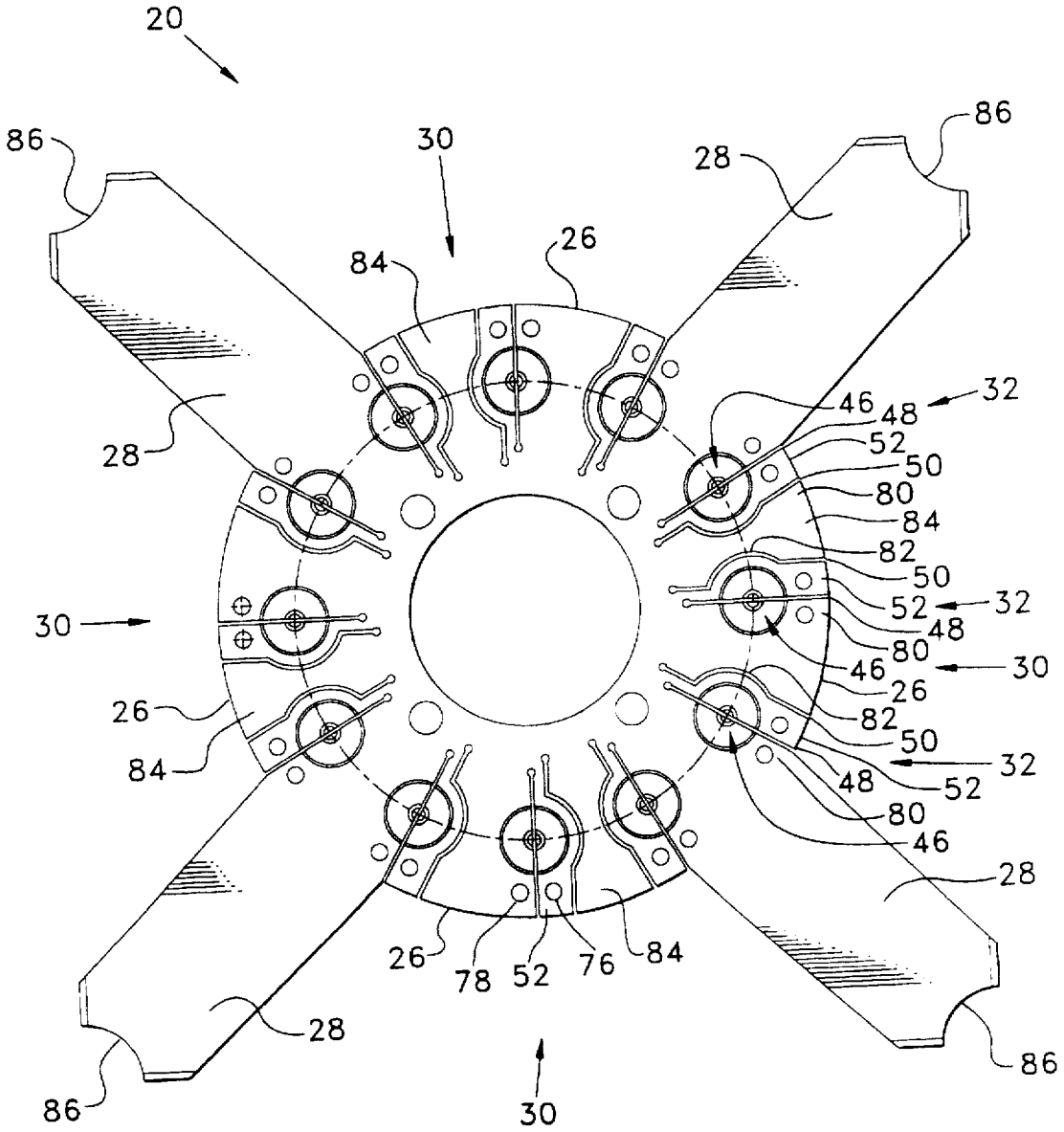
FIG. 2 is a top plan view of the fixture as shown in FIG. 1 in which clamp mechanisms have been removed from clamping assemblies in order to more clearly show the structure of the clamping assemblies associated with a plate portion of the fixture.
Figure 3:
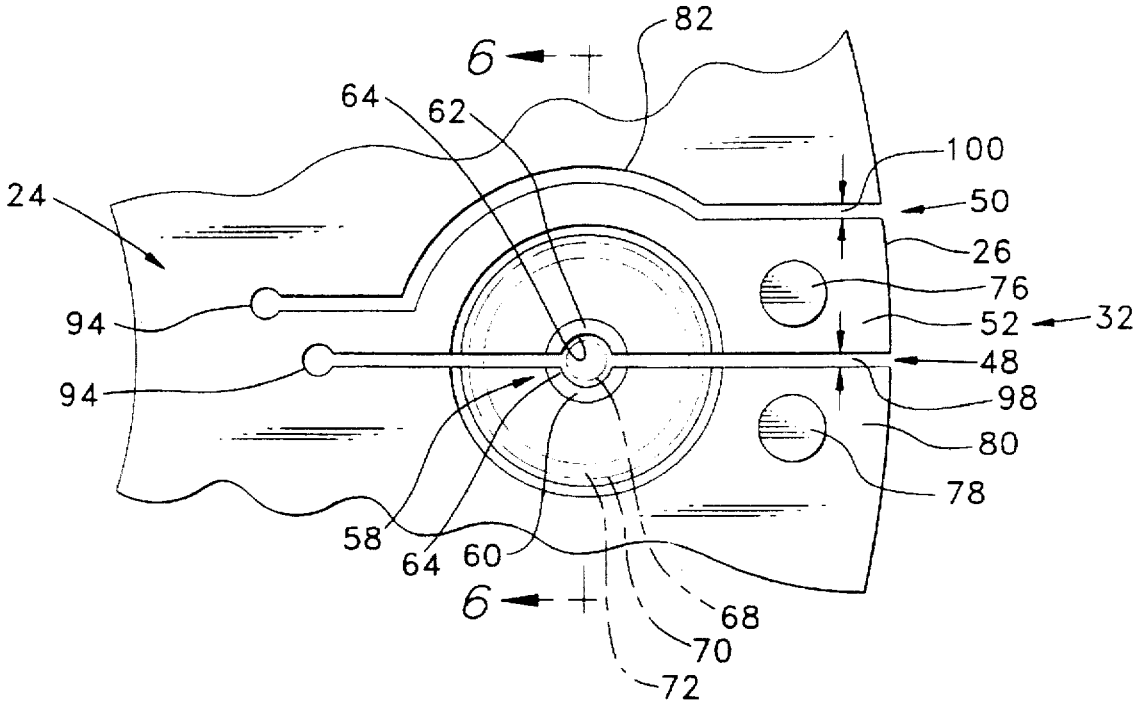
FIG. 3 is an enlarged partial fragmentary, plan view of one of the clamping assemblies as shown in FIG. 2 showing a connector receiving nest in which is positioned a connector shown in phantom line, a primary slot extending from a perimeter of the plate and through the nest, a secondary slot spaced away from the nest and the primary slot and a cantilevered beam positioned therebetween.

As shown in FIG. 2, each segment 30 of the plate portion 24 of the fixture 20 includes a group of the plurality of clamping assemblies 32 attached to the plate portion 24. As shown herein the group of the clamping assemblies 32 within the segments 30 are generally equal in number. Each of the clamping assemblies 32 in each segment 30 are generally radially oriented relative to the plate portion 24. Further, the groups of clamping assemblies 32 being positioned within the segments 30 is advantageous since this arrangement eliminates extending a slot through each of the arms.

According to the teachings of the present invention, slots 48, 50 extend through the plate portion of the corresponding segment 30. Eliminating a slot extending through the arms 28 improves the stability of the arms 28 and therefore the mounting of the fixture by the arms 28 to the machine.

Each clamping assembly 32 includes a nest 46 which is configured to receive an optical fiber connector therein. A primary slot 48 extends from the perimeter 26 of the plate portion 24 towards the center of the plate portion 24. A secondary slot 50 is spaced away from the primary slot 48 and does not pass through the nest 46 as does the primary slot 48. Rather, the secondary slot 50, extends from the perimeter 26 of the plate portion 24 through the plate portion inwardly toward a center thereof at a position which is spaced away from the primary slot 48. A beam 52 is defined as the structure between the primary slot 48 and secondary slot 50. The beam 52 is cantilevered from the plate portion 24 and moveable relative to the plate portion 24 at a root portion 53.

As shown in FIGS. 3–7, each clamping assembly 32 includes the nest 46 which includes a recessed area in the plate portion 24 defined by walls 54 and a base 56. While a generally cylindrical nest 46 recess is shown, nests of other shapes may be employed. A split adaptor barrel 58 extends upwardly from the base 56 and is divided by the primary slot 48 extending therethrough. The primary slot 48 bisects the barrel 58 dividing it into two generally arcuate walls 60, 62. When a clamping mechanism 44 is operated, the inside surfaces 64 of the walls 60, 62 are urged into engagement against an outside surface 66 of a ferrule 68 positioned concentrically extending through the split adaptor barrel 58.

Figure 6:
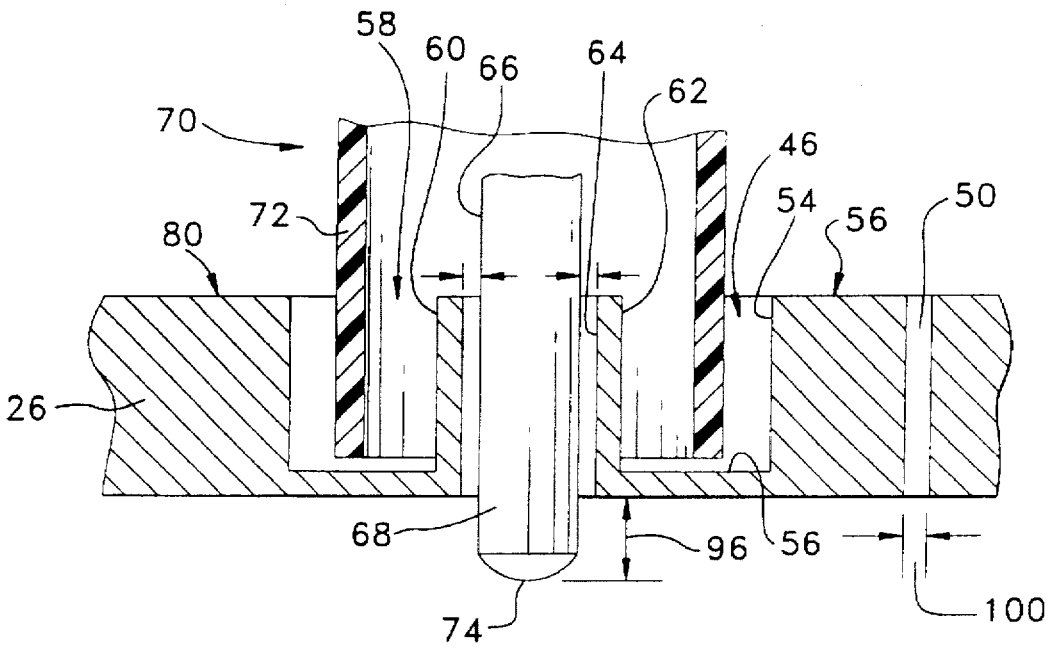
FIG. 6 is a partial fragmentary, cross-sectional, side elevational view taken along line 6—6 in FIG. 3 showing a connector (illustrated in phantom line in FIG. 3) positioned for engagement by the clamping assembly and in which the clamping assembly is in an open position.
Figure 7:
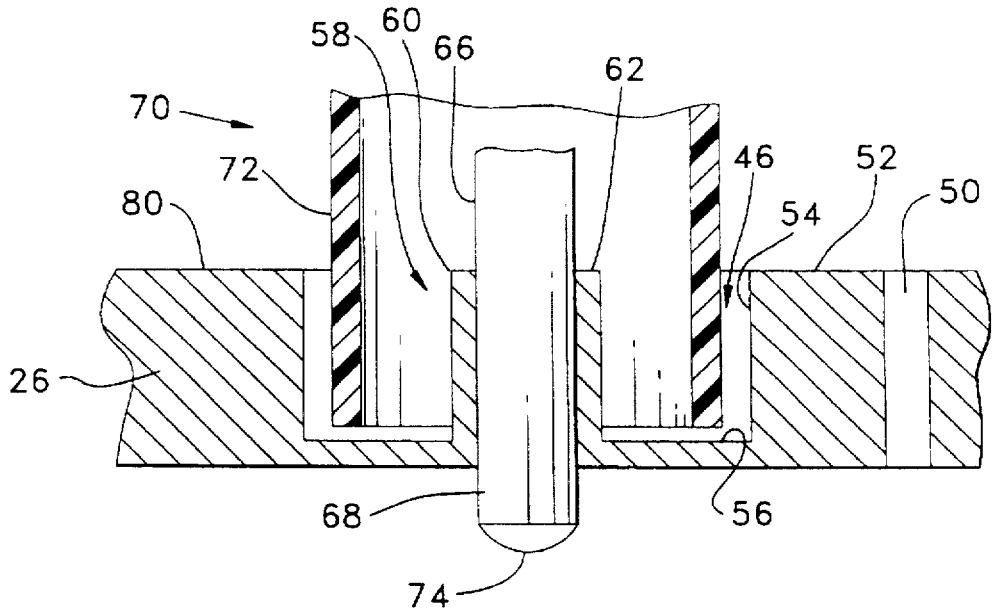
FIG. 7 is a partial fragmentary, cross-sectional, side elevational view of the connector positioned in the clamping assembly as shown in FIG. 6 and in which the clamping assembly has been operated to engage or clamp a ferrule of the connector.

Description of the clamping function will make reference to clamping point one or point one as identified by reference numeral 76 and clamping point two or point two as identified by reference numeral 78. Further description of the operation of the structure of the clamping assembly 32 of the present invention may include reference to a connector 70 which is shown in FIG. 6 having a housing 72 spaced away from the ferrule 68 extending therethrough. A tip 74 of the ferrule 68 including a portion of optical fiber is disposed on the end of the ferrule 68. This connector 70 is shown in phantom line in FIG. 3 including a phantom ferrule 68 and housing 72 in the interest of clarity.

The cantilevered moveable beam 52 can be considered a jaw of a clamping apparatus. The oppositely positioned structure is identified as a fixed jaw 80. The use of the moveable jaw 52 which moves relative to the fixed jaw 80 provides flexibility in the moveable beam or jaw 52 thereby providing a desired range of deflection. A deflection range of the beam 52 accommodates manufacturing tolerances present in the ferrules of the connectors 70 to be retained therein. Further, the secondary slot 50 is positioned generally equidistantly away from the primary slot or the clamping inside surfaces 64 of the nest 46 over a substantial length of the beam 52. This can be seen by the curved portion 82 which follows the outline of the circular nest wall 54. This generally equidistant spacing helps to improve the clamping forces imposed by the clamping mechanism 44 on the beam 52. Equidistant spacing is maintained over a substantial length of the beam 52 from the root 53 towards the perimeter 26 for providing generally uniform deflection and clamping forces.

Areas of the plate portion, or lands 84, positioned between opposed beams 52, need not be removed since lands 84 improve the rigidity of the stationary components of the plate portion 24 and add additional weight which may be employed in the polishing process. During the polishing process, it is advantageous to create a downward force on the ends of the fibers being polished against the abrasive surface 40. The additional weight may be employed to improve the downward force on the abrasive surface 40.

Additionally, it should be noted that the fixture retaining clamps 42 are spring biased to provide a degree of downward force on mounting ends 86 of the arm 28. The mounting ends 86 are positioned against the fixture retaining clamps 42 which exert a downward force thereon. The downward force created by the fixture retaining clamps 42 is transmitted along the length of the arms to the plate portion 24 of the fixture 20. As such, the arms facilitate improved polishing by transmission of such forces to the connectors retained in the nest.

Figure 4:
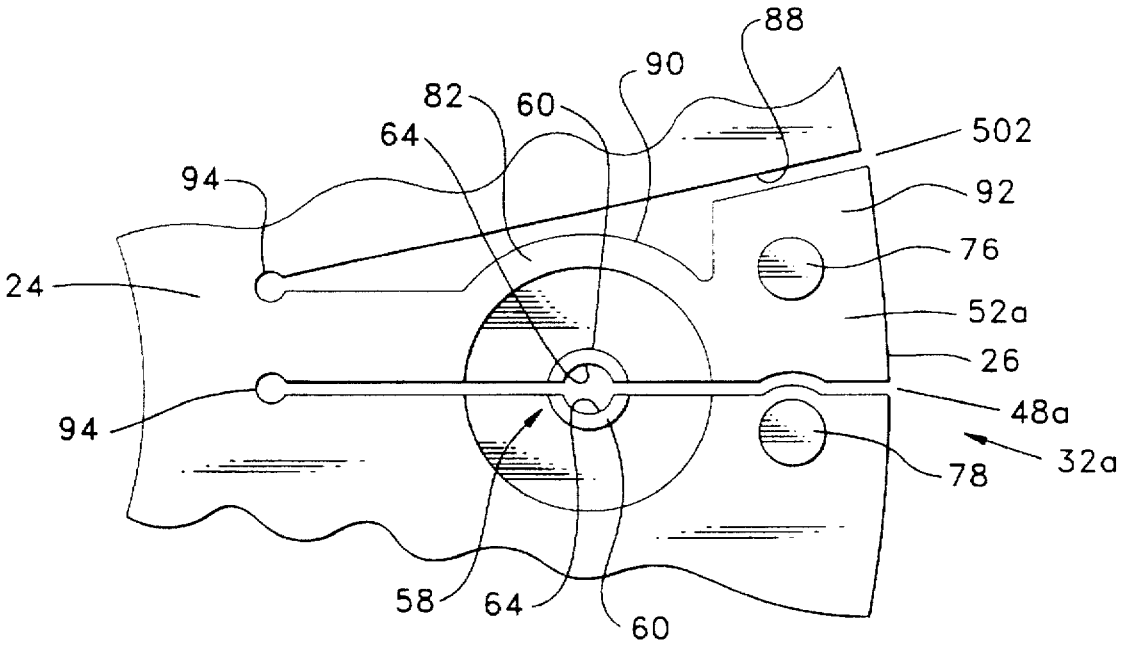
FIG. 4 is an enlarged, partial fragmentary, top plan view of an alternate embodiment of the clamping assembly which is similar to the clamping assembly as shown in FIG. 3.
Figure 5:
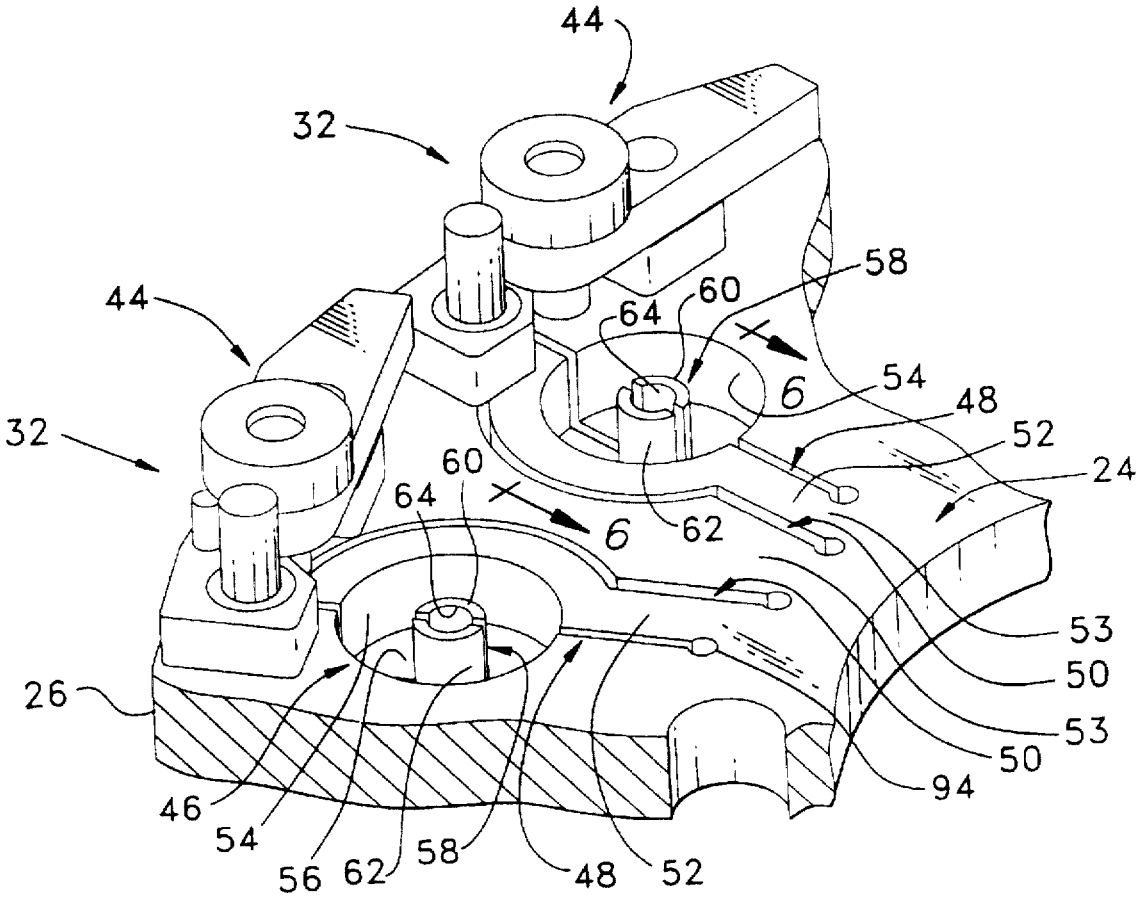
FIG. 5 is an enlarged, partial fragmentary, perspective view of a pair of clamping assemblies based on the fixture as shown in FIG. 1 and including a clamping mechanisms attached to the plate portion of the fixture straddling the primary slot.

An alternate embodiment of the clamping assembly **32*a* of the present invention is shown in FIG. 4. In FIG. 4 the clamping assembly 32*a* includes a radially extending edge 88 and an edge 90 which is generally equidistantly spaced from the primary slot 48 to define a gap or secondary slot 50*a* therebetween. This alternate embodiment produces an extension 92 on the perimeter edge of the beam 52*a*. The extension permits clamping point one and clamping point two (76, 78) to be positioned further apart and to position clamping point one 76 further away from the split barrel adapter 58. By increasing the distance from clamping point one 76 to the split barrel adapter 58, a greater moment arm may be achieved thereby facilitating desired clamping forces by the clamping mechanism 44**.

The improved geometry of the beam 52 design of the present invention provided by the primary and secondary slots 48, 50 defining the beam 52 improves the clamping forces in the clamping assembly 32. The moveable cantilevered beam 52 is more flexible than prior art designs with the oppositely positioned fixed positioned jaw 80 being more rigid than prior art designs which use two deflectable beams. The improved clamping provided by the beam and jaw 52, 80 of the present invention on ferrules 68 also allows a range of manufacturing tolerances thereby improving the universality of the fixture. In other words, the manufacturing tolerances of the dimensions of the connector assembly and especially the ferrule may be less strict and still promote desired retention of the ferrule in the clamping assembly.

In each of the embodiments, it is desirable to provide an enlarged slot terminus 94 on the innermost end of the primary and secondary slots 48, 50. The enlarged terminus 94 is a hollow, generally cylindrical structure employed to minimize material fatigue created by deflection of the beam 52 during frequent clamping cycles.

Previously filed U.S. patent application Ser. No. 08/337,585, filed Nov. 10, 1994 and which is assigned to the assignee of the present application is incorporated herein by reference.

In use, a connector 70 is placed in the nest 46 with the tip 74 end of the ferrule 68 extending through a corresponding split adapter barrel 58 a predetermined dimension of extension 96. The precise dimension of extension 96 is achieved using a setup plate which is the subject of a separate patent application assigned to the assignee of the present application. Once the ferrule 68 is positioned with the desired extension 96, the clamp mechanism 44 is operated to draw or deflect the beam 52 towards the fixed jaw 80. In this operation, point one 76 is drawn toward point two 78 thereby decreasing the dimension 98 of the primary slot 48 and increasing the dimension 100 of the secondary slot 50. The change in the dimensions 98, 100 represents the deflection of the beam 52 during the clamping operation. This deflection produces a clamping force which brings the arcuate wall 60, 62 of the split adapter barrel 58 closer together to the point that the outside surface 66 of the ferrule 68 is engaged by the inside surface 64 of the arcuate walls 60, 62. The open position of the clamping assembly 32 as described hereinabove is shown more clearly in FIG. 6 with the resultant closed or clamped position shown in FIG. 7.

The cylindrical construction of the nest 46 and the split adapter barrel 58 accommodates a wide range of connector geometries. As such, a variety of connector housings may be positioned in the nests 46 of the fixture 20 with the ferrules being clamped in the split barrel for simultaneous polishing. The universality of the present fixture 20 eliminates the need to have numerous fixtures to polish different styles of connectors.

While a preferred embodiment of the present invention is shown and described, it is envisioned that those skilled in the art may devise various modifications and equivalents without departing from the spirit and scope of the appended claims. The invention is not intended to be limited by the foregoing disclosure.

The invention claimed is:

1. A polishing fixture for use with a polishing machine which polishes articles retained in said fixture, said fixture comprising:

a body portion having perimeter edge portions;

positioning structures extending from said body portion for positioning said fixture relative to said polishing machine;

a plurality of segments of said body portion being defined in areas between neighboring ones of said positioning structures; and a plurality of article clamping assemblies positioned within each segment and disposed on said perimeter edge portions.

2. A polishing fixture as recited in claim 1, each of said clamping assemblies further comprising:

a nest for retaining an article on said body portion;

a primary slot extending from said perimeter of said body portion, through said body portion and said nest;

a secondary slot spaced away from said primary slot and extending from said perimeter of said body portion to a position proximate to said nest;

a moveable beam being defined between said primary slot and said secondary slot, said moveable beam being displaceable relative to said body portion;

a clamping mechanism attached to said beam and said body portion, said clamping mechanism straddling said primary slot for imposing clamping forces on a portion of an article retained in said nest and retaining said article therein for polishing.

3. A polishing fixture as recited in claim 2, further comprising said body portion having a circular plate configuration and said slots being positioned in corresponding ones of said segments along said perimeter of said circular plate, said plurality of clamping assemblies being generally, radially oriented in corresponding ones of said plurality of segments.

4. A polishing fixture as recited in claim 3, wherein said moveable beam is cantilevered from a central portion of said circular plate portion and moveable relative to said circular plate portion.

5. A polishing fixture as recited in claim 4, further comprising a second beam being a generally fixed cantilevered beam, said clamping mechanism being attached to said moveable beam and to said second beam, said second beam being generally stationary when said clamping mechanism is operated to clamp a portion of an article in a corresponding nest.

6. A polishing fixture as recited in claim 1, each of said clamping assemblies further comprising:

a nest for retaining an article on said body portion;

a primary slot extending from said perimeter of said body portion, through said body portion and said nest;

a secondary slot spaced away from said primary slot and extending from said perimeter of said body portion to a position proximate to said nest;

a moveable beam being defined between said primary slot and said secondary slot, said moveable beam being displaceable relative to said body portion;

said secondary slot being generally equidistantly spaced away from said primary slot over a substantial portion of a length of said beam;

a clamping mechanism attached to said beam and said body portion, said clamping mechanism straddling said primary slot for imposing clamping forces on an article retained in said nest and retaining a portion of an article therein for polishing.

7. Polishing fixture as recited in claim 6, said secondary slot further comprising a first generally linear section and a curved section spaced away from and positioned around one side of said nest.

8. A polishing fixture as recited in claim 1, each of said clamping assemblies further comprising:

a nest for retaining an article on said body portion;

a primary slot extending from said perimeter of said body portion, through said body portion and said nest;

a secondary slot spaced away from said primary slot and extending from said perimeter of said body portion to a position proximate to said nest;

a moveable cantilevered beam being defined between said primary slot and said secondary slot, said moveable cantilevered beam being displaceable relative to said body portion;

said secondary slot being generally equidistantly spaced away from said primary slot over a substantial portion of a length of said beam, said secondary slot includes a first generally linear section, a curved section spaced away from and positioned around one side of said nest, and an enlarged gap being formed between moveable cantilevered beam and said body portion; and a clamping mechanism attached to said beam and said body portion, said clamping mechanism straddling said primary slot for imposing clamping forces on a portion of an article retained in said nest and retaining said article therein for polishing.

9. An optical fiber connector polishing fixture for use with a polishing machine which polishes optical fiber connectors retained in said fixture, said optical fiber connectors having a ferrule with at least one optical fiber positioned therein, said fixture comprising:

a generally circular plate portion having a perimeter edge;

a plurality of arms extending outwardly from said perimeter edge of said plate portion for positioning said fixture relative to said polishing machine;

a plurality of segments of said plate portion being defined in areas between neighboring arms extending from said plate portion;

a plurality of connector clamping assemblies spaced around said perimeter of said plate portion, groups of said plurality of connector clamping assemblies being positioned in a corresponding one of said plurality of segments of said plate portion and each of said connector clamping assemblies in said groups being generally radially oriented relative to said plate portion within said segment;

each of said connector clamping assemblies including a nest for retaining a connector, a primary slot extending from said perimeter of said plate portion, through said plate portion and said nest, a secondary slot spaced away from said primary slot and extending from said perimeter of said plate portion to a position proximate to said nest, and a clamping mechanism;

a moveable beam being defined between said primary slot and said secondary slot, said moveable beam being displaceable relative to said plate portion; and one of said clamping mechanisms being attached to said beam and said plate portion straddling said primary slot for imposing clamping forces on a connector retained in said nest and retaining said connector therein for polishing.

10. An optical fiber connector polishing fixture as recited in claim 9, further comprising said secondary slot being generally equidistantly spaced away from said primary slot over a substantial portion of a length of said beam.

11. An optical fiber connector polishing fixture as recited in claim 9, further comprising said secondary slot being generally equidistantly spaced away from said primary slot over a substantial portion of a length of said beam, said secondary slot including a first generally linear section and a curved section spaced away from and positioned around one side of said nest.

12. An optical fiber connector polishing fixture as recited in claim 9, further comprising said secondary slot being generally equidistantly spaced away from said primary slot over a substantial portion of a length of said beam, said secondary slot includes a first generally linear section, a curved section spaced away from and curving around said nest, an enlarged gap being formed between moveable cantilevered arm and said plate portion.

13. A polishing fixture in combination with a polishing machine which polishes portions of generally axially oriented articles retained in said fixture when said fixture is attached to said machine; said machine having a frame, a drive motor attached to said frame, a polishing device operatively associated with said frame and driven by said drive motor, and fixture retainers depending from said frame; said fixture comprising:

a body portion having a perimeter edge;

positioning structures extending from said body portion for positioning said fixture relative to said polishing machine;

a plurality of segments of said body portion being defined in areas between neighboring ones of said positioning structures; and a plurality of article clamping assemblies positioned on said body portion, groups of said plurality of article clamping assemblies being positioned within each of said segments and disposed on said perimeter edge.

* * * * *